US010333255B2

(12) United States Patent
Zhang et al.

(10) Patent No.: US 10,333,255 B2
(45) **Date of Patent: *Jun. 25, 2019**

(54) ELECTRICAL CONNECTOR HAVING SHELL RETENTION STRUCTURE AND METHOD OF ASSEMBLING THE SAME

(71) Applicant: FOXCONN INTERCONNECT TECHNOLOGY LIMITED, Grand Cayman (KY)

(72) Inventors: Wen-Fang Zhang, Kunshan (CN); Wei Zhong, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

This patent is subject to a terminal disclaimer.

(21) Appl. No.: 16/118,478

(22) Filed: Aug. 31, 2018

(65) Prior Publication Data

US 2019/0067880 A1 Feb. 28, 2019

(30) Foreign Application Priority Data

Aug. 31, 2017 (CN) ..... 2017 2 1111602 U

(51) Int. Cl.

| | |
|---|---|
| ***H01R 13/6581*** | (2011.01) |
| ***H01R 13/6585*** | (2011.01) |
| ***H01R 13/502*** | (2006.01) |
| ***H01R 43/18*** | (2006.01) |
| ***H01R 43/20*** | (2006.01) |
| *H01R 13/62* | (2006.01) |
| *H01R 13/6582* | (2011.01) |

(52) U.S. Cl.

CPC ..... *H01R 13/6585* (2013.01); *H01R 13/502* (2013.01); *H01R 43/18* (2013.01); *H01R 43/20* (2013.01); *H01R 13/6205* (2013.01); *H01R 13/6581* (2013.01); *H01R 13/6582* (2013.01)

(58) Field of Classification Search

CPC ..... H01R 13/6581; H01R 13/6582

See application file for complete search history.

(56) References Cited

U.S. PATENT DOCUMENTS

2017/0352992 A1* 12/2017 Lin ..... H01R 12/7005
2018/0166831 A1* 6/2018 Zhu ..... H01R 13/6581

FOREIGN PATENT DOCUMENTS

CN 106684618 A 5/2017

* cited by examiner

*Primary Examiner* — Tho D Ta

(74) *Attorney, Agent, or Firm* — Wei Te Chung; Ming Chieh Chang

(57) ABSTRACT

An electrical connector includes an insulative housing enclosed within a metallic shell wherein the housing forms a mating cavity and the shell includes a first shell and a second shell assembled together. The first shell includes a main body abutting against the housing, and a folded plate abutting against the main body and having a plurality of first spring tangs for engagement with the case in which the connector is position. The folded plate forms a securing tab and the housing includes a retention slot receiving the securing tab therein so as to prevent outward movement of the folded plate in the vertical direction.

20 Claims, 8 Drawing Sheets

ELECTRICAL CONNECTOR HAVING SHELL RETENTION STRUCTURE AND METHOD OF ASSEMBLING THE SAME

BACKGROUND OF THE DISCLOSURE

1. Field of the Disclosure

The present disclosure relates to an electrical connector, and more particularly to an electrical connector having the corresponding metallic shell attached thereto in a special sequential assembling steps.

2. Description of Related Arts

U.S. Patent Application Publication No. 2018/0166831 having the same applicant with the instant application, discloses an electrical connector with an insulative housing enclosed by a metallic shell having a folded plate with corresponding spring tangs thereon for engagement with the exterior case in which the connector is disposed. Because there is no proper fixing piece to secure the folded plate in position with regard to the housing, the folded plate tends to be sprung out, thus resulting in defects thereof.

An improved electrical connector is desired.

SUMMARY OF THE DISCLOSURE

Accordingly, an object of the present disclosure is to provide an electrical connector with metallic shell having the folded plate with corresponding spring tangs thereon wherein the folded plate includes a securing tab retained to the housing.

To achieve the above object, an electrical connector includes an insulative housing enclosed within a metallic shell wherein the housing forms a mating cavity and the shell includes a first shell and a second shell assembled together. The first shell includes a main body abutting against the housing, and a folded plate abutting against the main body and having a plurality of first spring tangs for engagement with the case in which the connector is position. The folded plate forms a securing tab and the housing includes a retention slot receiving the securing tab therein so as to prevent outward movement of the folded plate in the vertical direction.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
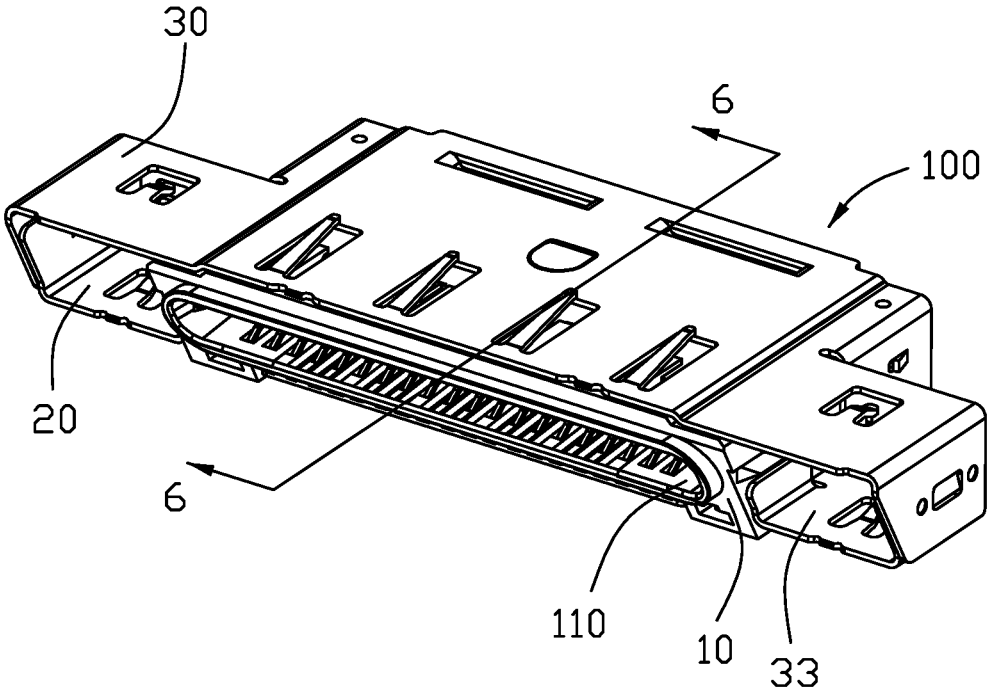
FIG. 1 is a front downward perspective view of an electrical connector according to one embodiment of the invention.
Figure 2:
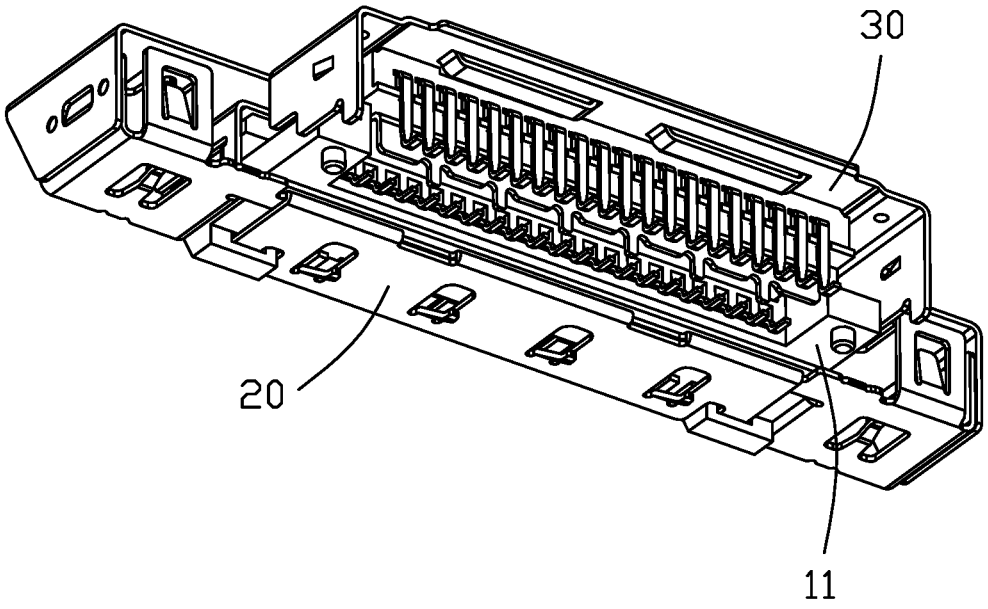
FIG. 2 is a rear upward perspective view of the electrical connector of FIG. 1.
Figure 3:
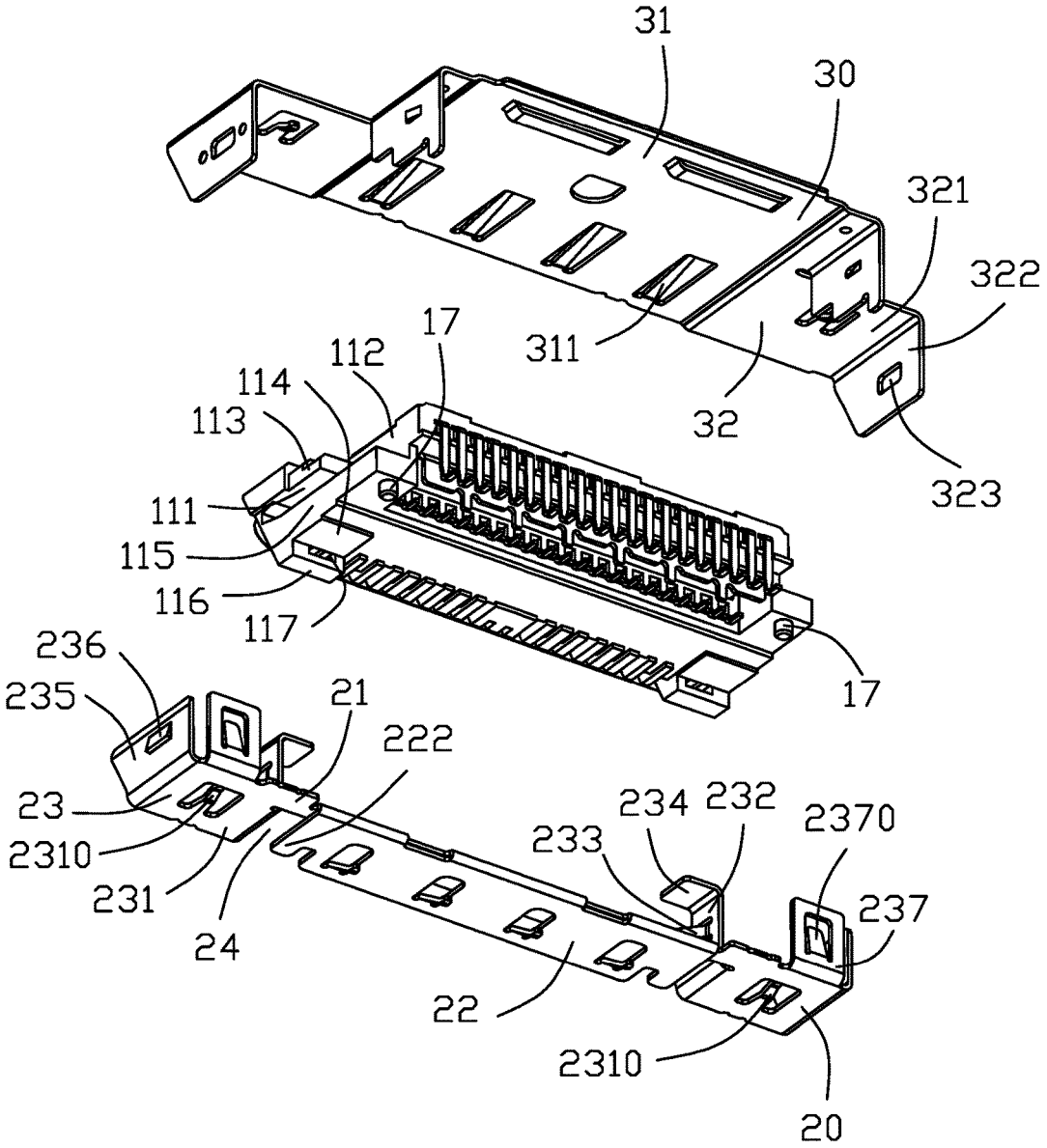
FIG. 3 is a rear upward exploded perspective view of the electrical connector of FIG. 3.
Figure 4:
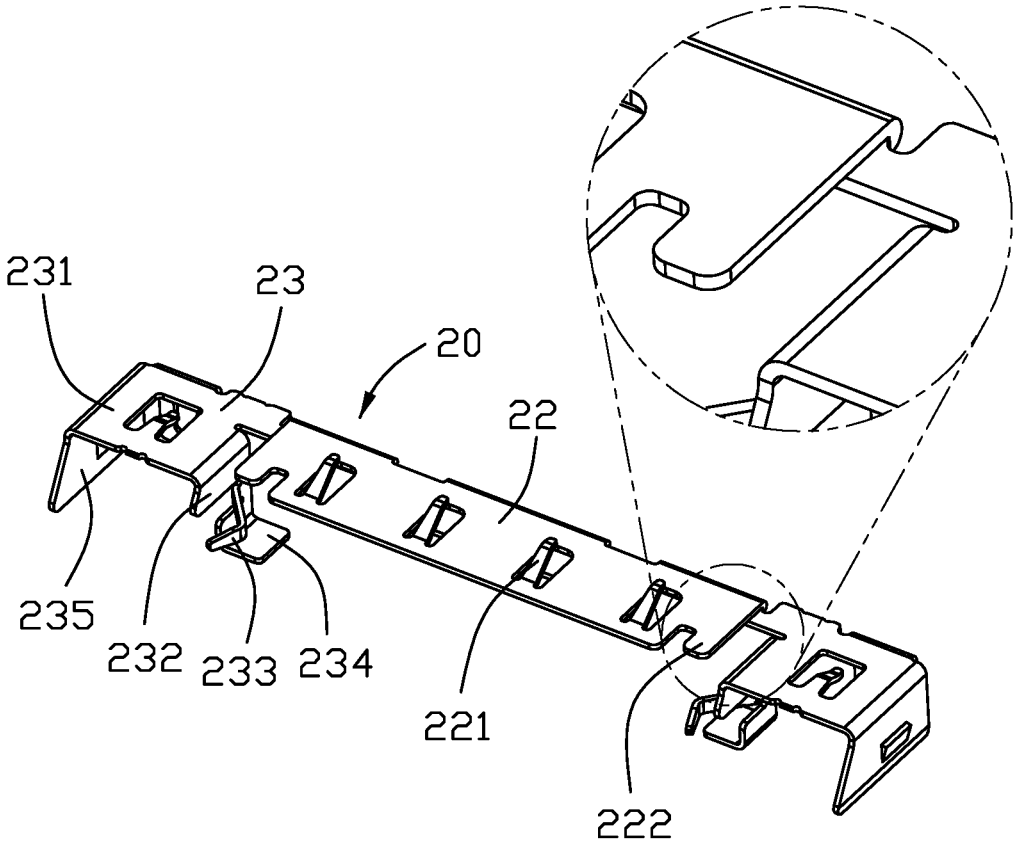
FIG. 4 is an upside-down perspective view of the lower shell of the electrical connector of FIG. 3.
Figure 5:
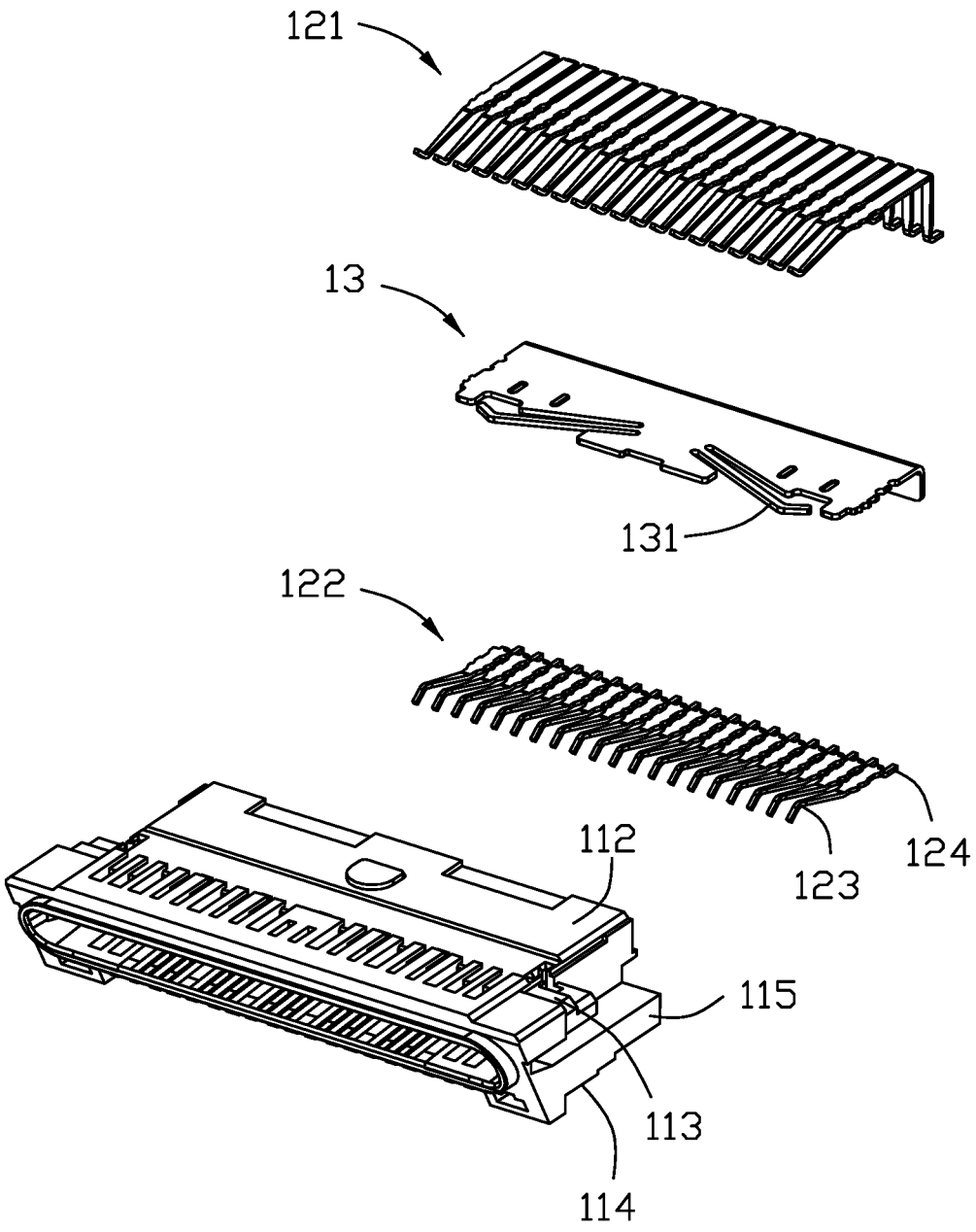
FIG. 5 is a front downward exploded perspective view of the electrical connector of FIG. 1 without the metallic shell.
Figure 6:
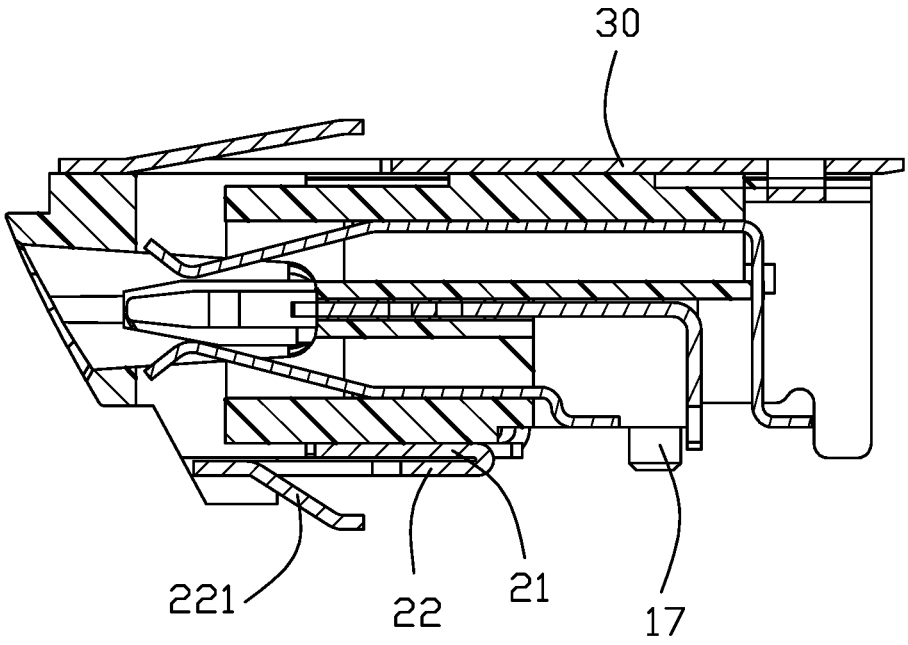
FIG. 6 is a cross-sectional view of the electrical connector of FIG. 1.

Reference will now be made in detail to the embodiments of the present disclosure. The embodiment will be shown in FIGS. 1 to 6. An electrical connector 100 adapted to be mounted to a printed circuit board, includes a main body 10, a metallic shell set including a first/lower metallic shell 20, a second/upper metallic shell 30 and further a third/rear shell (not shown in the embodiment while being referable to the aforementioned U.S. Patent Application Publication No. 2018/0166831, The first shell 20 and the second shell 30 or even the third shell are assembled together to commonly enclose the main body 10. The main body 10 includes an insulative housing 11 and a plurality of contacts 12 and a metallic shielding plate 13 commonly retained in the housing 11. The contacts 12 include the upper contacts 121 and the lower contacts 122 and the shielding plate 13 is located therebetween in the vertical direction.

The housing 11 includes an elongated mating cavity 110 extending along a longitudinal direction and exposed to an exterior forwardly in a front-to-back direction perpendicular to the longitudinal direction for receiving a complementary connector (not shown). The housing 11 forms a pair of grooves 111 in the opposite ends in the longitudinal direction. The housing 11 includes opposite top surface 112 and bottom surface 114, and opposite side surfaces 115. A pair of blocks 116 are formed on the bottom surface 114. Each block 116 forms a retention slot 117 extending along the front-to-back direction from a rear face of the block 116. Both the upper contacts 121 and the lower contacts 122 have corresponding contacting sections 123 extending into the mating cavity 110, and corresponding soldering sections 124 for soldering to the printed circuit board (not shown).

The first shell 20 covers the bottom surface 114 of the housing 11 and the second shell 30 covers the top surface 112 of the housing 11. The first shell 20 further includes a main plate 21 intimately covering the bottom surface 114 and a folded plate 22 reversely/forwardly extending from a rear edge of the main plate 21 and intimately covering the main plate 21 and further extending forwardly beyond the main plate 21 to abut against the bottom surface 114. Notably, the bottom surface 114 forms a step structure thereon so that both the main plate 21 and the folded plate 22 abut against the stepped bottom surface 114. The folded plate 22 includes a plurality of first spring tangs 221 extending rearward in the front-to-back direction and outwardly in the vertical direction for engagement with the case (not shown). Understandably, the spring tang 221 essentially extends obliquely. The folded plate 22 further includes a pair of securing tabs 222 respectively retained within the corresponding retention slots 117, thus preventing outwardly deflection of the folded plate 22. The first shell 20 further includes a pair of first additional sections 23 at two opposite ends of the main plate 21. The first additional section 23 includes a first horizontal section 231, a first extension 232 extending upwardly from an inner edge of the first horizontal section 231 in a vertical direction, and a second extension 235 extending upwardly from an outer edge of the first horizontal section 231. The first extension 232 forms the spring finger 233 which extends through the corresponding groove 111 into the mating cavity 110 for mating with the complementary connector (not shown). The first extension 232 further includes a bending section 234 extending horizontally from an upper edge of the first extension 232 toward the mating cavity 110 and abuts against the step 113 formed on the top surface 112 so as to retain the first shell 20 in position in the vertical direction. Notably, the material of the bending section 234 and the first extension 232 is derived from that of the main plate 21 corresponding to the space between the pair of first additional sections 23. A side extension 237 extends upwardly from the side edge of the horizontal section 231.

The second shell 30 includes the second main plate 31 and a pair of second additional sections 32. The second main plate 31 forms a plurality of second spring tangs 311 opposite to the first spring tangs 221 for engagement with the aforementioned case (not shown). The second additional section 32 includes a second horizontal section 321 and the third extension 322 extending downwardly from the second horizontal section 321 for engagement with the corresponding second extension 235. The second extension 235 forms a securing block 236 and the third extension 322 forms a securing hole 323 receiving the securing block 236. The first additional section 23 and the corresponding second additional section 32 commonly form a receiving cavity 33 for receiving a magnet (not shown) therein. The first horizontal section 231 further includes a spring tab 2310 extending upwardly and the side extension 237 further includes a sprint tab 2370 extending forwardly in the front-to-back direction into the receiving cavity 33 for contacting such a magnet in the receiving cavity 33. Notably, the deflectable arms 131 of the shielding plate 13 extend forwardly into the mating cavity 110 for mechanically and electrically connected to the complementary connector (not shown) received in the mating cavity 110.

Figure 7:
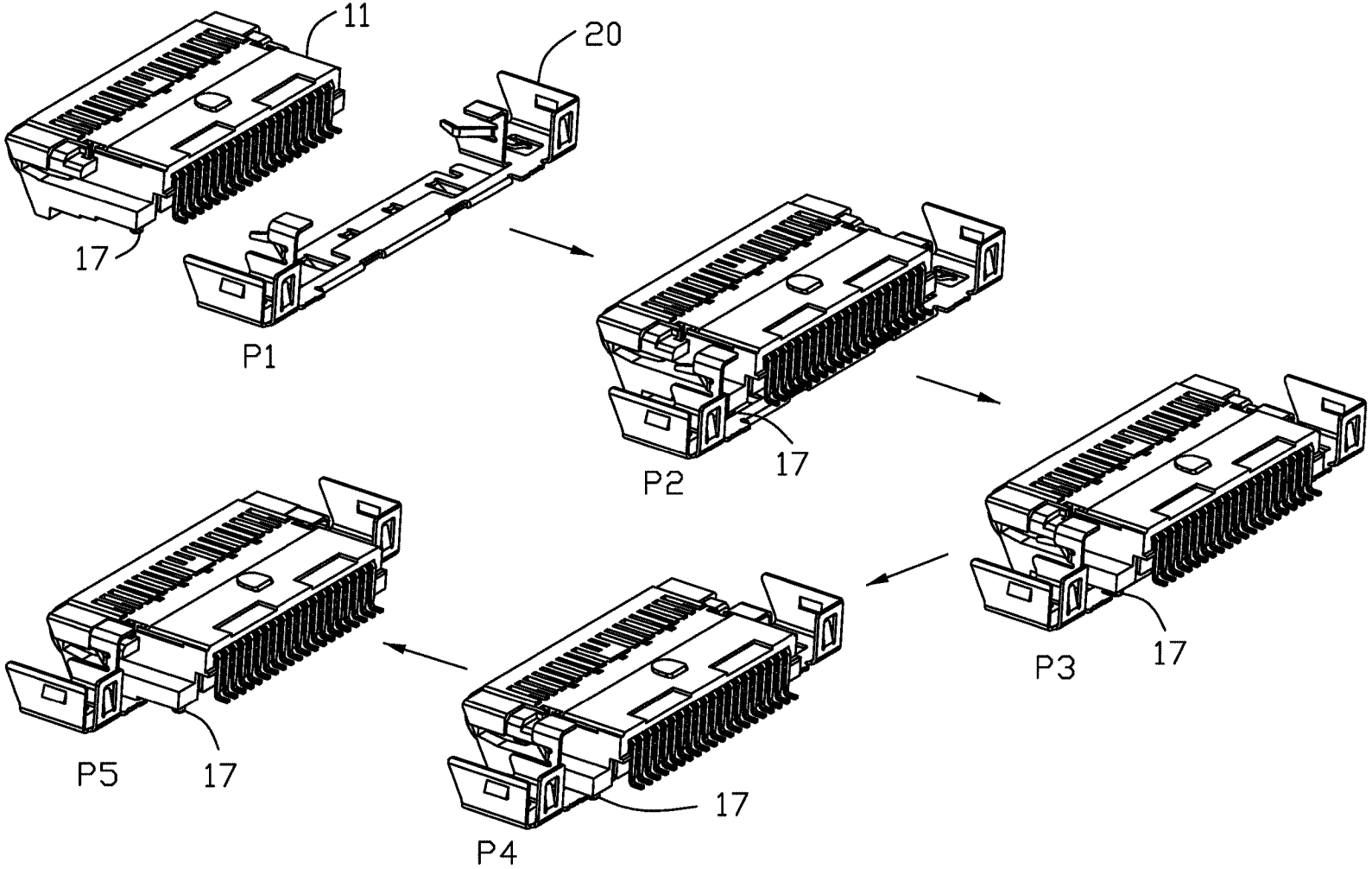
FIG. 7 is a perspective view to show how the lower shell is assembled to the housing of the electrical connector of FIG. 1.
Figure 8:
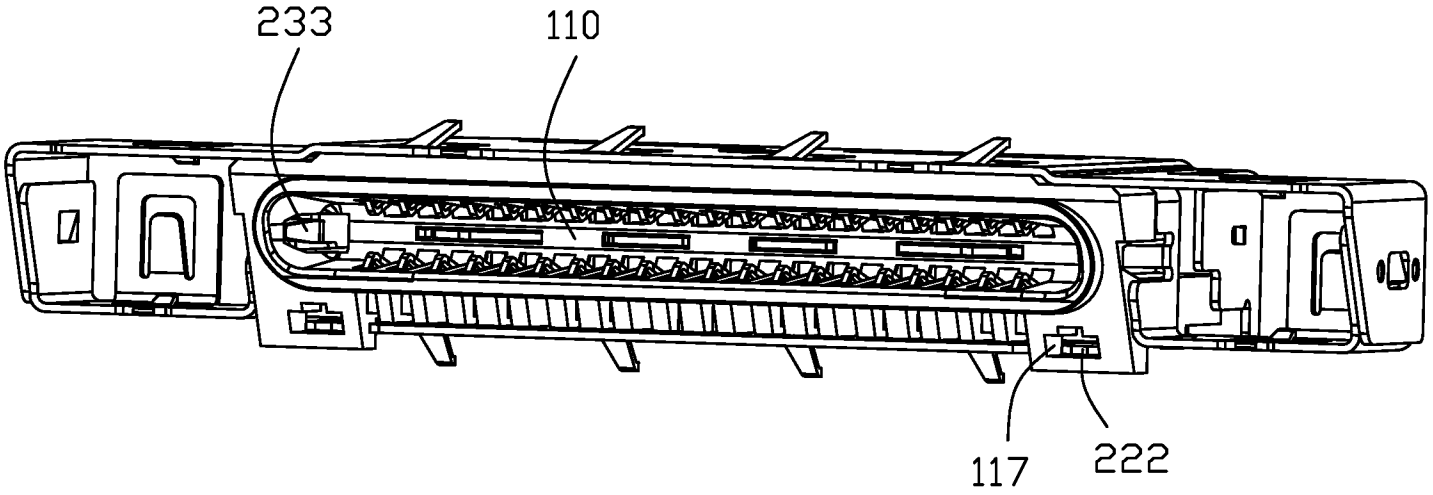
FIG. 8 is a front perspective view of the electrical connector of FIG. 1.

One feature of the invention is regarding the assembling method of the first shell 20 to the housing 11. Because there are a pair of mounting posts 17 extending downwardly from the bottom surface 114 and the main plate 21 of the first shell 20 abuts against the bottom surface 114 when the first shell 20 is completely assemble unto the housing 11, those mounting posts 17 may hinder directly forwardly assembling the first shell 20 to the housing 11 from the rear side of the housing 11. Therefore, in a side view a Z-shaped assembling path of the first shell 20 is required during assembling as shown in FIG. 7 wherein the first shell 20 is forwardly approaching the housing 11 from the back with a predetermined vertical position relative to the housing 11, i.e., a low vertical position, to pass the mounting posts 17 without interference as shown in P1 to P3, and successively upwardly moved, in the vertical direction, with a predetermined vertical position, to a high vertical position to as shown in P4, and finally forwardly moved to the final position as shown in P5 where the bending section 234 abuts against the step 113, the spring finger 233 extends through the corresponding groove 111 into the mating cavity 110, and the securing tab 222 is received within the retention slot 117.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

an insulative housing extending along a longitudinal direction and defining therein a mating cavity forwardly communicating with an exterior along a front-to-back direction perpendicular to said longitudinal direction, and opposite top and bottom surfaces in a vertical direction perpendicular to both longitudinal direction and said front-to-back direction;

a plurality of contacts disposed in the housing with corresponding contacting sections extending into the mating cavity;

a metallic shell set including a lower shell intimately covering the bottom surface; wherein said lower shell includes a main plate upwardly abutting against the bottom surface in the vertical direction, a folded plate extending forwardly from a rear edge of the main plate and upwardly abutting against the main plate in the vertical direction with a plurality of spring tangs extending outwardly in the vertical direction, and a securing tab extending from the folded plate and retained in the housing.

2. The electrical connector as claimed in claim 1, wherein the lower shell further includes a pair of additional sections at two opposite ends of the main plate, and each additional section includes a first horizontal section extending from the main plate horizontally, and a first extension extending from an inner edge of the first horizontal section upwardly in the vertical direction with a spring finger extending through a groove at an end of the housing in said longitudinal direction into the mating cavity.

3. The electrical connector as claimed in claim 2, wherein the first extension further includes a bending section extending horizontally from a top edge thereof toward the mating cavity in the longitudinal direction and abutting against the housing in the vertical direction.

4. The electrical connector as claimed in claim 3, wherein said bending section abuts against a step formed on the bottom surface of the housing in the vertical direction.

5. The electrical connector as claimed in claim 2, wherein the first horizontal section further includes a spring tab extending upwardly in the vertical direction.

6. The electrical connector as claimed in claim 2, where a side extension extends upwardly from a side edge of each first horizontal section with a spring tab extending forwardly in the front-to-back direction.

7. The electrical connector as claimed in claim 2, wherein a second extension extends upward from an outer edge of each first horizontal section with means for locking with an upper shell of the metallic shell set to commonly define a receiving cavity above each first horizontal section.

8. The electrical connector as claimed in claim 1, wherein said housing further includes a pair of mounting posts unitarily extending downwardly form the bottom surface behind the main plate of the lower shell.

9. The electrical connector as claimed in claim 8 wherein a tip of each mounting post is lower than the main plate of the lower shell in the vertical direction.

10. The electrical connector as claimed in claim 1, wherein a front portion of the folded plate further abuts against the bottom surface of the housing in the vertical direction.

11. A method of making an electrical connector comprising steps of:

providing an insulative housing with a mating cavity extending along a longitudinal direction and forwardly communicating with an exterior in a front-to-back direction perpendicular to said longitudinal direction, and opposite top surface and bottom surface in a vertical direction perpendicular to both the longitudinal direction and the front-to-back direction;

assembling a plurality of contacts into the housing with corresponding contacting sections exposed within the mating cavity;

providing a metallic lower shell with a main plate abutting upwardly against the bottom surface, and a folded plate extending forwardly from a rear edge of the main plate and beyond a front edge of the main plate; wherein the folded plate forms a plurality of spring tangs extending outwardly in the vertical direction and a securing tab extending forwardly and retained in a corresponding retention slot of the housing so as to prevent downward movement of the folded plate away from the main plate in the vertical direction.

12. The method as claimed in claim 11, wherein the folded plate abuts against the main plate in the vertical direction.

13. The method as claimed in claim 11, wherein the lower shell further includes a pair of additional sections at two opposite ends of the main plate in the longitudinal direction, and each additional section includes a first horizontal section, a first extension upwardly extends from an inner edge of the first horizontal section with a spring finger extending through a corresponding groove of the housing into the mating cavity, and a bending section extends inwardly in the longitudinal direction from a top edge of the first extension to abut against around the top surface of the housing.

14. The method as claimed in the claim 13, wherein the housing further includes a pair of mounting posts unitarily extending from the bottom surface behind the main plate.

15. The method as claimed in claim 14, further including a step of forwardly, from a rear side of the housing along said front-to-back direction, assembling the lower shell upon the housing via a Z-shaped path in a side view, wherein the main plate initially passes the posts and the lower shell is in a low vertical position, the lower shell is upwardly moved from the low position to a high position successively, and finally moved forwardly to a final position where the securing tab is received in the retention slot, the spring finger extends into the mating cavity and the bending section abuts against the top surface in the vertical direction.

16. An electrical connector comprising:

an insulative housing forming a mating cavity extending along a longitudinal direction and communicating forwardly with an exterior in a front-to-back direction perpendicular to said longitudinal direction, and defining opposite top surface and bottom surfaces in a vertical direction perpendicular to both the longitudinal direction and the front-to-back direction;

a plurality of contacts disposed in the housing with corresponding contacting sections extending into the mating cavity;

a metallic shell set attached upon the housing and including a first shell having a main plate covering one of said top surface and said bottom surface, and a folded plate extending forwardly from a rear edge of the main plate in the front-to-back direction and intimately confronting the main plate in the vertical direction with a plurality of spring tangs extend outwardly in the vertical direction and further with a securing tab retained in the housing to prevent movement of the folded plate relative to the main plate in the vertical direction, and a second shell attached upon the other of said top surface and said bottom surface.

17. The electrical connector as claimed in claim 16, wherein the first shell and the second shell are secured with each other.

18. The electrical connector as claimed in claim 16, wherein said housing further includes a pair of posts unitarily extending from said one of the top surface and said bottom surface and located behind the main plate in the front-to-back direction.

19. The electrical connector as claimed in claim 18, wherein the posts are dimensioned in the vertical direction to prevent a simple forward movement of the first shell for assembling the first shell to the housing.

20. The electrical connector as claimed in claim 16, wherein said first shell further includes a pair of additional sections at two opposite ends of the main plate, and each of said additional sections includes a first horizontal section coplanar with the main plate, and a first extension extending from an inner edge of the first horizontal section in the vertical direction with a sprint finger extending into the mating cavity in the longitudinal direction.

* * * * *